US005254034A

United States Patent [19]

Roth

[11] Patent Number: 5,254,034

[45] Date of Patent: Oct. 19, 1993

[54] ADJUSTABLE WIDTH LOUVER

[75] Inventor: Ronald A. Roth, Philadelphia, Pa.

[73] Assignee: Penn Ventilator Company, Inc., Philadelphia, Pa.

[21] Appl. No.: 691,555

[22] Filed: Apr. 25, 1991

[51] Int. Cl.[5] ..... F24F 13/18

[52] U.S. Cl. ..... 454/277

[58] Field of Search ..... 98/99.7, 99.8, 121.1

[56] References Cited

U.S. PATENT DOCUMENTS

| | | | |
|---|---|---|---|
| 903,340 | 11/1908 | Townsend | 98/99.7 X |
| 1,173,686 | 2/1916 | Sortore | 98/99.8 |
| 1,657,625 | 1/1928 | Hoal | 98/121.1 |
| 1,782,098 | 11/1930 | Majuschak | 98/121.1 X |
| 1,879,534 | 9/1932 | Schmidt | 98/99.8 X |
| 2,183,955 | 12/1939 | Bean | 98/99.8 X |
| 2,194,388 | 3/1940 | Haugh | 98/121.1 |
| 3,645,195 | 2/1972 | Koval | 98/121.1 |

*Primary Examiner*—Harold Joyce

*Attorney, Agent, or Firm*—Dann, Dorfman, Herrell and Skillman

[57] ABSTRACT

An adjustable louver includes a longitudinally spaced pair of side frame numbers, a spaced apart pair of end members extending between the side members and including inner and outer submembers slidably engaging to extend or telescope through a continuum of positions respecting one another and blades extending between the side members with each blade including blade members which slidably engage to extend substantially through the continuum of positions through which said end members are extendable.

13 Claims, 7 Drawing Sheets

ADJUSTABLE WIDTH LOUVER

FIELD OF THE INVENTION

This invention relates to louvers used in air handling and ventilating equipment.

BACKGROUND OF THE INVENTION

In air handling and ventilating equipment, louvers are used to permit air flow into or out of a building while preventing the elements from entering the building through the opening for the air. Conventionally, louvers come in fixed sizes to fit in fixed-sized openings. Conventional louvers range from relatively small sizes, in the neighborhood of 18 inches in height, up to 48 inches in height, with similar ranges in width.

The variety of sizes of louvers conventionally used and specified by architects for buildings makes it necessary for louver manufacturers and distributors to manufacture and stock a wide range of sizes of louvers. This is expensive.

Additionally, while professional builders, carpenters and the like may have no difficulty installing a given-size louver in a given-size opening, homeowners and other do-it-yourselfers may have difficulty making an orifice the exact width required to receive a given louver.

The necessity for distributors to carry a wide range of louver sizes reduces distributor responsiveness to orders. If the distributor does not have the size louver proper in stock, the distributor cannot respond to a given order in a timely fashion.

SUMMARY OF THE INVENTION

In one of its aspects, this invention provides an adjustable louver which includes a longitudinally spaced pair of side members having cross-sections symmetrical about an axis and a spaced-apart pair of upper and lower end members extending between the side members, with each of the end members including inner and outer submembers slidably engaging to extend through a continuum of positions respecting one another. The side members are sometimes referred to as "jambs." The end members are sometimes referred to as "heads" and "sills", with the higher end member (when installed) being the "head" and the lower end member being the "sill."

Preferably, the inner submembers of the head and sill have common cross-sectional shape and the outer submembers of the head and sill also have common cross-sectional shape.

Blades extend between the side members or jambs. Each blade includes blade members, preferably two in number, slidably engaging to extend substantially through the continuum of positions, between the jambs, respecting one another, as the jambs are moved toward or away from one another.

The blade members preferably have common cross-sectional shape and are of common cross-section. Each of the blade members preferably includes a slat portion, which may be generally planar, extending substantially the length of the blade member in the direction of blade member movement. The slat portion is preferably in a plane skew to a plane in which the side and end members reside.

Each of the blade members also preferably includes a pair of generally planar web portions, extending substantially the length of the blade members in the direction of blade member movement. In each of the blade members, a first one of the web portions preferably defines a transverse extremity of the blade member extending substantially the length of the blade in the direction of blade member movement. A remaining web portion is preferably parallel with the first web portion.

Each of the blade members further preferably includes a hook portion extending from the remaining web portion with the hook portion slidably receiving the first web portion of the remaining blade member of the pair (of blade members) which together define the blade. The hook portion preferably extends substantially the length of the blade member in the direction of blade member movement.

Each blade member further preferably includes first and second intermediate portions connecting the web portions to the slat portion. The two intermediate portions are preferably parallel one with another.

The louver further preferably includes screens, preferably two in number, having side edges aligned with and secured to respective side members. The screens are adapted to overlap one another when the end members (the heads and sills) are in a position of minimum elongation. The screens are preferably of area substantially that subtended by the side members (the jambs) and the end members (the heads and sills) when the end members (the heads and sills) are at a position of maximum elongation.

DESCRIPTION OF THE PREFERRED EMBODIMENT AND BEST MODE KNOWN FOR PRACTICING THE INVENTION

Figure 1:
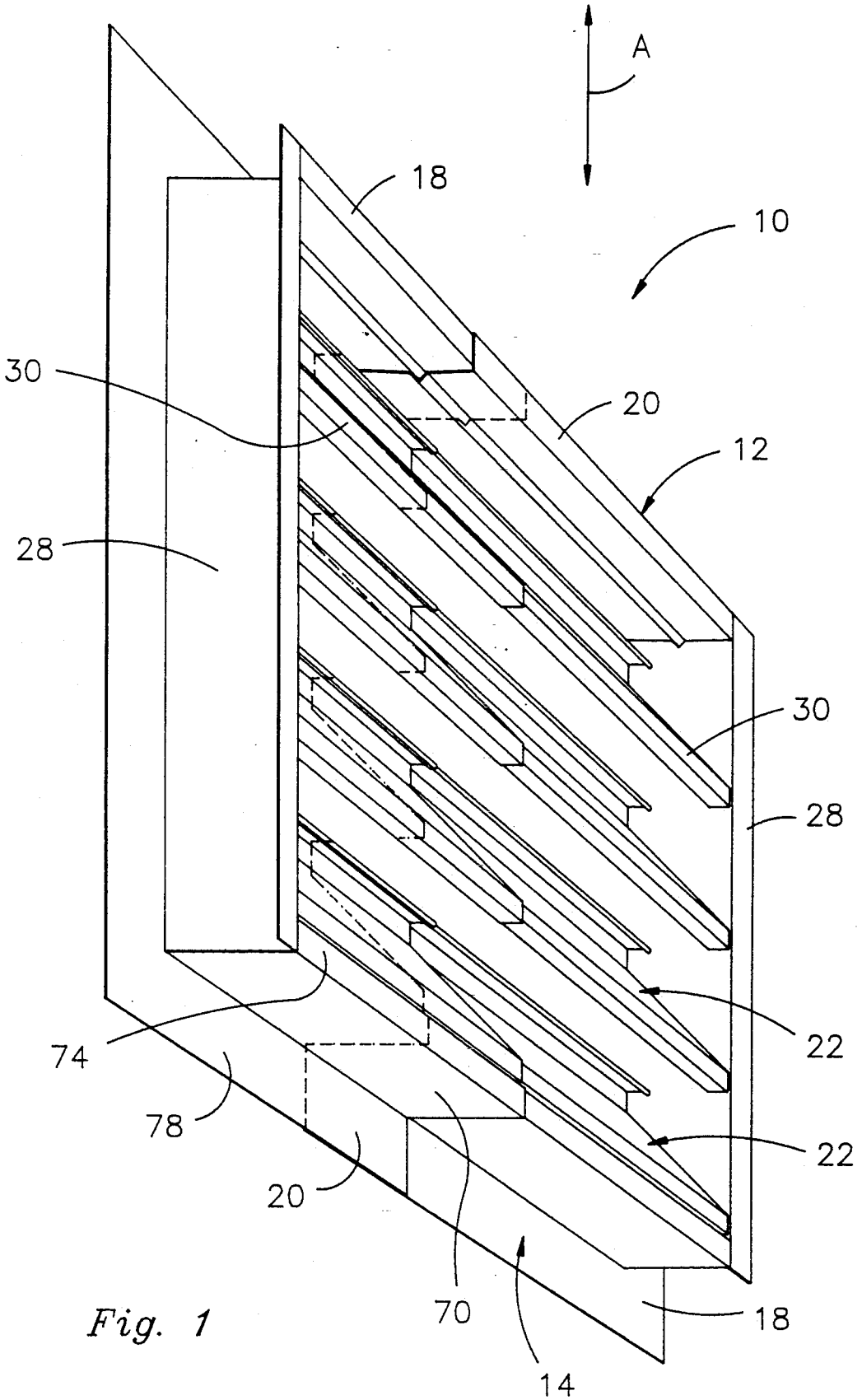
FIG. 1 is an isometric view of an adjustable louver manifesting the invention.
Figure 11:
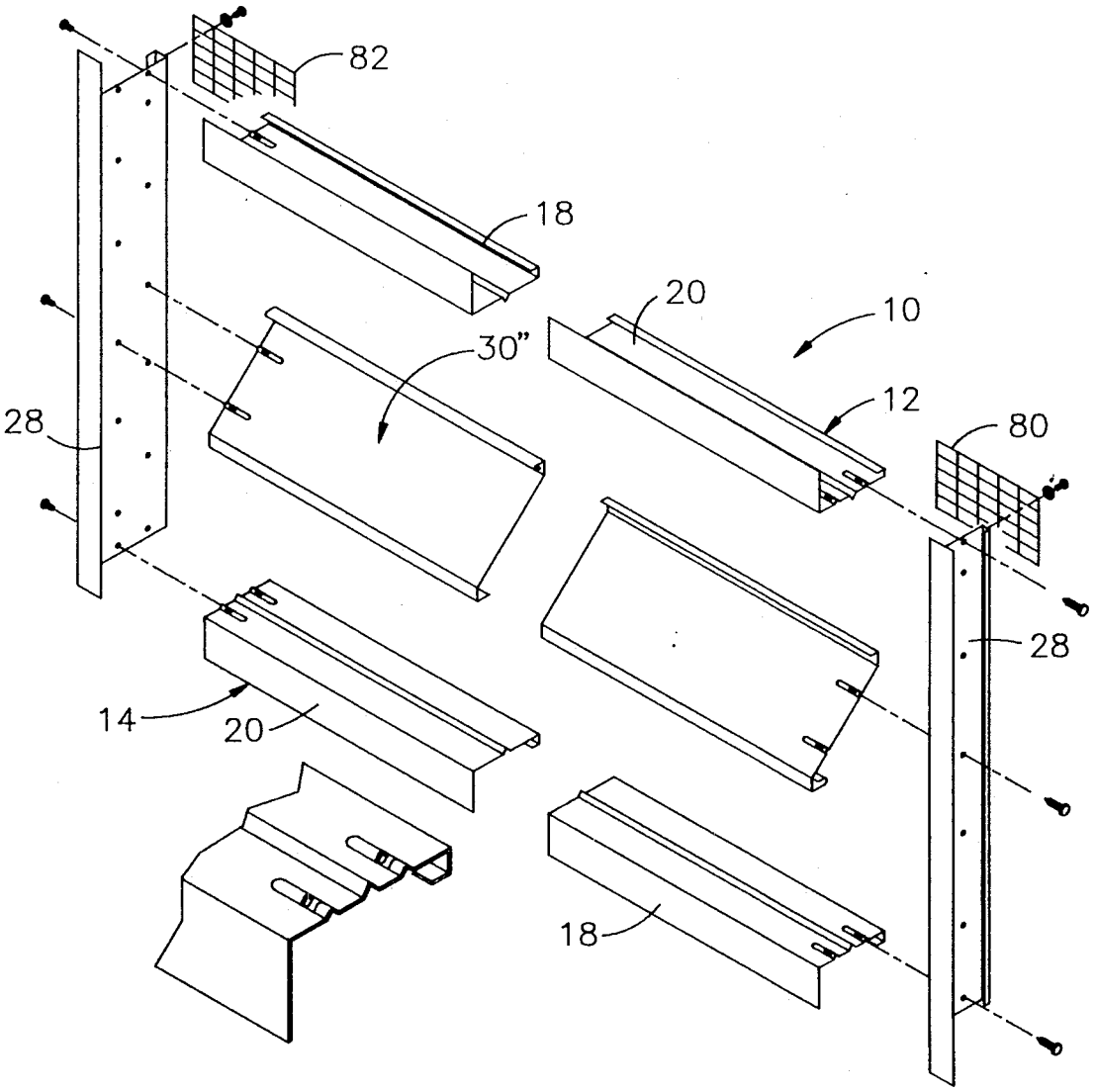
FIG. 11 is an exploded view of an adjustable louver embodying the invention, in which the blade members are of the configuration illustrated in FIG. 4.

Referring the drawings and to FIGS. 1 and 11 in particular, a horizontally adjustable louver manifesting the invention is designated generally 10 and includes a horizontally spaced parallel pair of vertically extending side members designated generally 28. Side members 28 preferably have cross-sections symmetrical about a louver vertical axis indicated as A in FIG. 1. Side members 28 are preferably parallel one to another and preferably extend in the vertical direction.

Louver 10 further includes a spaced apart, preferably parallel, pair of horizontally extending members, designated respectively 12, 14, extending between side members 28. Each horizontally extending member 12 and 14 preferably includes an inner submember and an outer submember slidably engaging the inner submember. The inner submembers have been designated generally 18 and the outer submembers have been designated generally 20 in FIGS. 1, 9 and 11.

Louver blades 22 extend between vertically extending jambs 28. Each louver blade 22 includes two blade members 30 which slidably engage one another in a nested, complemental configuration. The sliding engagement facilitates elongation and contraction of a blade 22 upon movement of jambs 28 respecting one another.

Inner submembers 18 respectively associated with horizontally extending members 12, 14 are preferably symmetrical and preferably identical one to another. Similarly, outer submembers 20 are preferably identical one to another and respectively slidably engage inner submembers 18 in the manner illustrated in FIGS. 1, 9 and 11.

Figure 8:
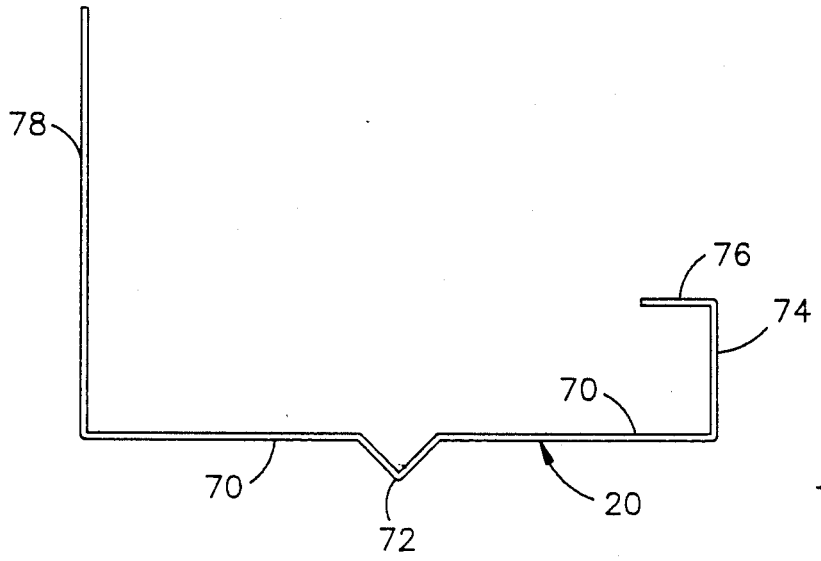
FIG. 8 is a sectional view of one member of a spaced apart pair of end members which form a part of the adjustable louver illustrated in FIG. 1; the end member illustrated in FIG. 8 is the outer member of the pair of adjustable end members.
Figure 9:
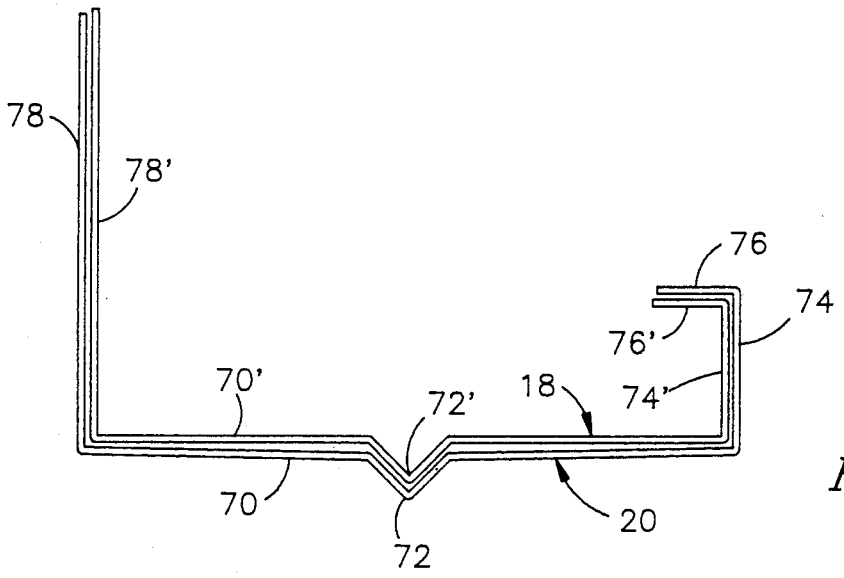
FIG. 9 is a sectional view similar to FIG. 8, showing the two end members of a pair in complemental contact, slidably engaging one another.

Referring to FIGS. 8 and 9, horizontally extending submember 20 includes a central portion 70 which is preferably generally horizontal when submember 20 is assembled with other component parts to define adjustable louver 10. Submember 20 has central portion 70 illustrated in FIGS. 1, 8, 9 and 11 and, as best illustrated in FIG. 8, includes a V-shaped elongated portion 72 defining a water barrier. Submember 20 further includes a land portion 74, which is preferably generally perpendicular to central portion 70, and yet further preferably includes a flange portion 76, which is preferably generally perpendicular to land portion 74 and is preferably generally parallel to the sill or central portion 70.

At the opposite end of central portion 70, horizontally extending outer submember 20 further includes a face portion 78 which is preferably generally perpendicular to central portion 70 and preferably generally parallel to land portion 74.

Horizontally extending inner submember 18 generally includes the same component parts as horizontally extending outer submember 20; these corresponding similar parts have been given corresponding numbers in FIG. 9, with prime notation denoting portions of horizontally extending inner submember 18. These portions are horizontal central portion 70', elongated V-shaped portion 72', land portion 74', flange portion 76' and face portion 78'. As with horizontally extending outer submember 20, in horizontally extending inner submember 18' flange portion 76' is preferably generally parallel with central portion 70', land portion 74' is preferably generally parallel with face portion 78' and central portion 70' and flange portion 76' are preferably generally perpendicular to land portion 74' and face portion 78'. These portions of horizontally extending inner submembers 18 are dimensioned to nest slidably complementally within and facingly contact corresponding portions of horizontally extending outer submember 20, as illustrated in FIG. 9.

Figure 2:
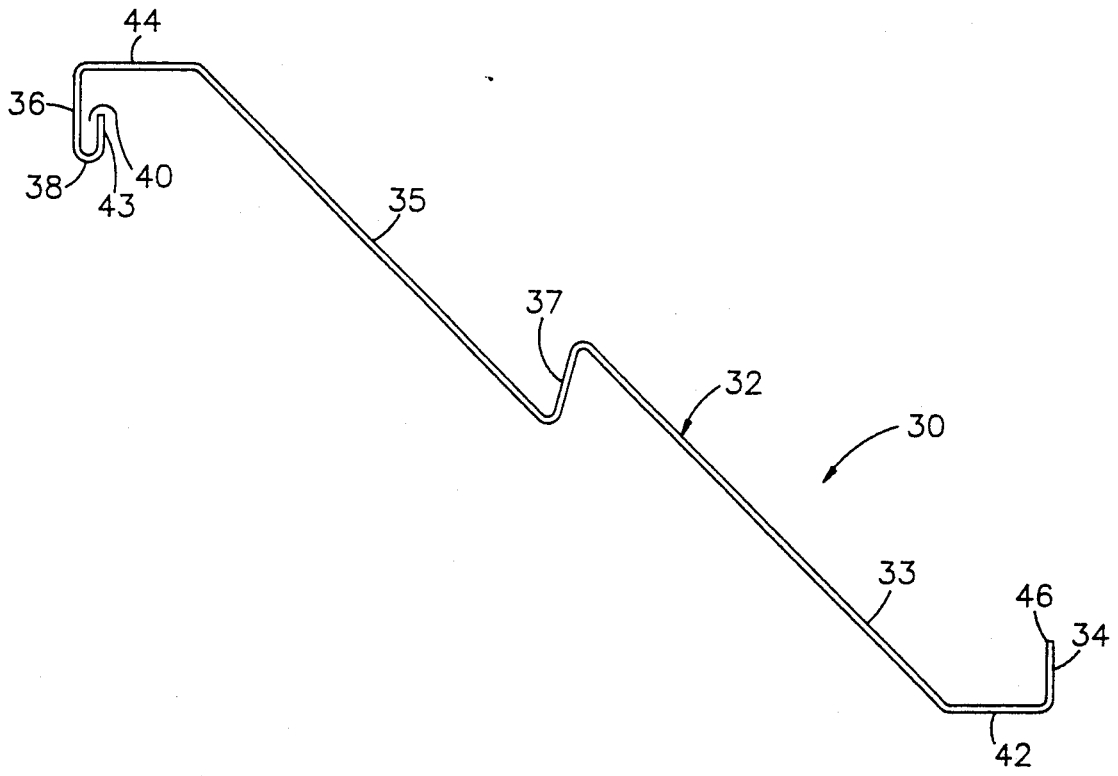
FIG. 2 is a sectional view of the preferred embodiment of a blade member, useable in the louver illustrated in FIG. 1.

In FIG. 2, a blade member is designated generally 30 and includes a slat portion 32 extending substantially the length of blade member 30 in the direction of blade member movement, which is perpendicular to the plane of the paper. Slat portion 32 is in turn preferably divided into two subportions 33, 35, with subportions 33, 35 joined together by an offset or bridging portion 37, all as illustrated in FIG. 2. Subportions 33 and 35 are preferably parallel to one another. Bridging portion 37 provides a barrier to entry of rain or other elements from the exterior into the interior of the building in which adjustable width louver 10 is installed. The two parallel planes within which subportions 33, 35 reside are respectively preferably skew to a plane in which side members 28 reside.

Figure 10:
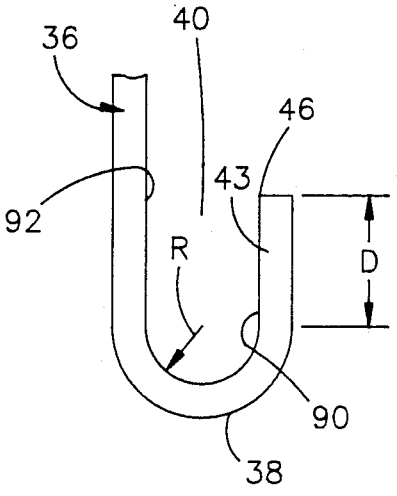
FIG. 10 is an enlarged view of the hook portion of the blade member illustrated in FIG. 2.

The blade member configuration illustrated in FIG. 2 represents the preferred embodiment of the blade member portion of the invention. FIGS. 1 and 10 have not been illustrated with all of the details of the blade member configuration illustrated in FIG. 2, to enhance clarity of the drawings.

Blade member 30 further preferably includes a pair of webs designated 34, 36 respectively. First web 34 defines an extremity of blade member 30 which preferably extends substantially the length of blade member 30 in the direction of blade member movement. The remaining or second web 36 is parallel with first web 34.

A hook portion 38 extends from second web 36 and curves towards slat portion 32 to define a receptacle 40.

First and second intermediate portions 42, 44 are preferably parallel and respectively connect parallel first and second webs 34, 36 to slat portion 32. Receptacle 40 is sized to receive a tip portion 46 of first web 34 of a remaining blade member 30. Receptacle 40 is of sufficient width receiving tip portion 46 and the immediately adjacent portion of first web 34 of a remaining blade member, to facilitate sliding movement of blade members 30 respecting one another, providing the adjustable width characteristic of the invention.

FIG. 10 illustrates hook portion 38 defining receptacle 40. An extension portion 43 extends from hook portion 38 with an extremity of extension portion 43 defining tip 46 of blade member 30. Extension portion 43 extends a distance indicated by dimension D in FIG. 10 from the curved portion of blade member 30 defining hook portion 38.

Figure 6:
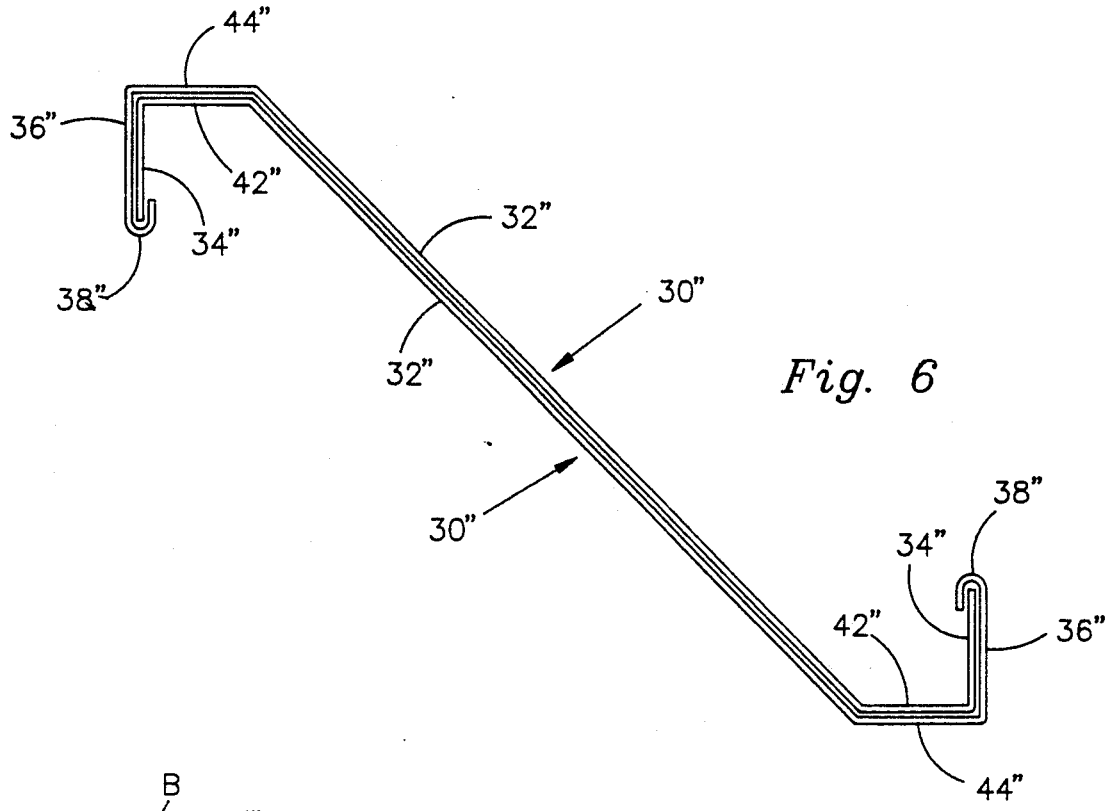
FIG. 6 is a sectional view showing two of the blade members illustrated in FIG. 4 in nested, complemental facing contact, slidably engaging one another.
Figure 7:
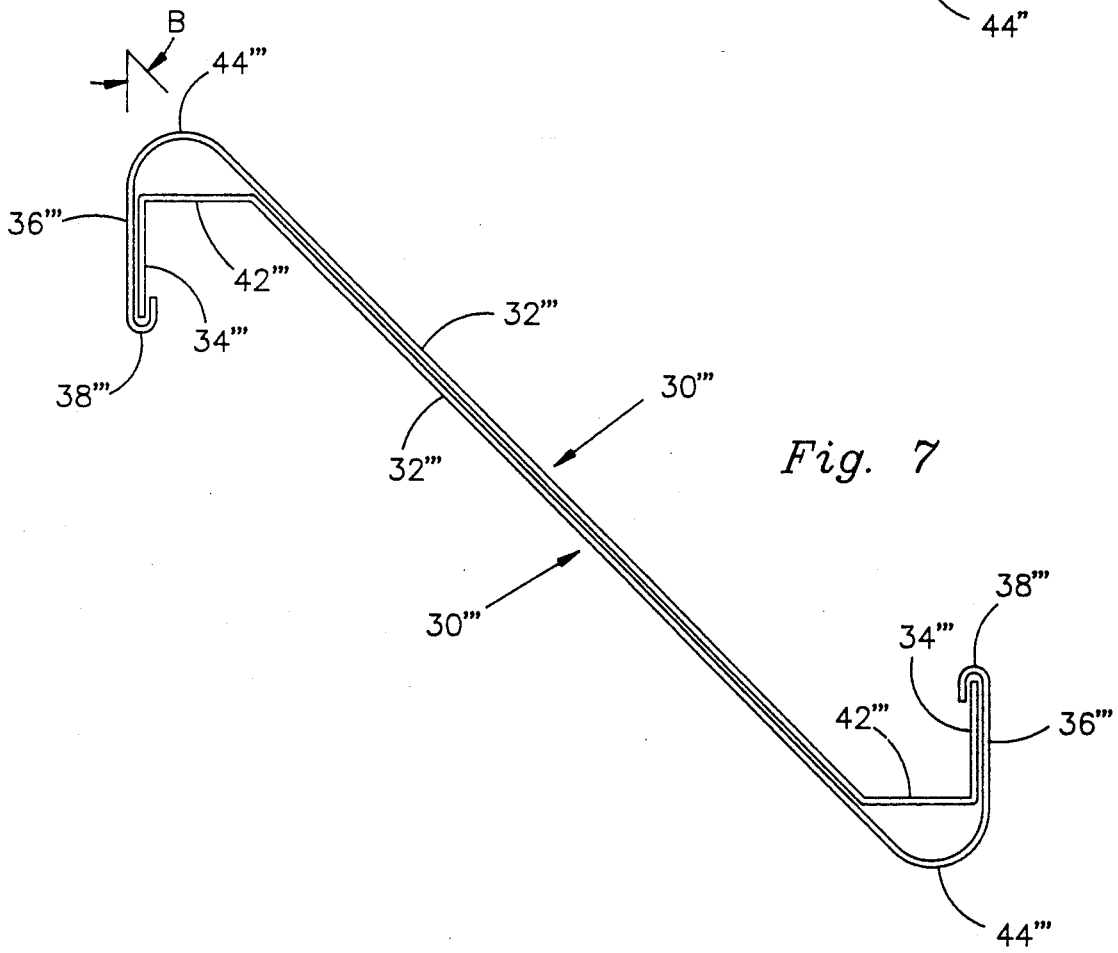
FIG. 7 is a sectional view, similar to that of FIG. 6, showing two of the blade members illustrated in FIG. 5 in nested, complemental facing contact, slidably engaging one another.

As further illustrated in FIG. 10, respective facing surfaces 90, 92 cf extension portion 43 and second web 36 are separated by a distance equal to twice radius R. This distance must be slightly greater than the thickness of the material from which blade member 30 is fabricated, in order for first web 34 to be slidably received between mutually facing surfaces 90, 92 of extension portion 43 and second web 36, as shown in FIGS. 6 and 7 illustrating the blades of the embodiments of FIGS. 4 and in nested configuration.

Figure 3:
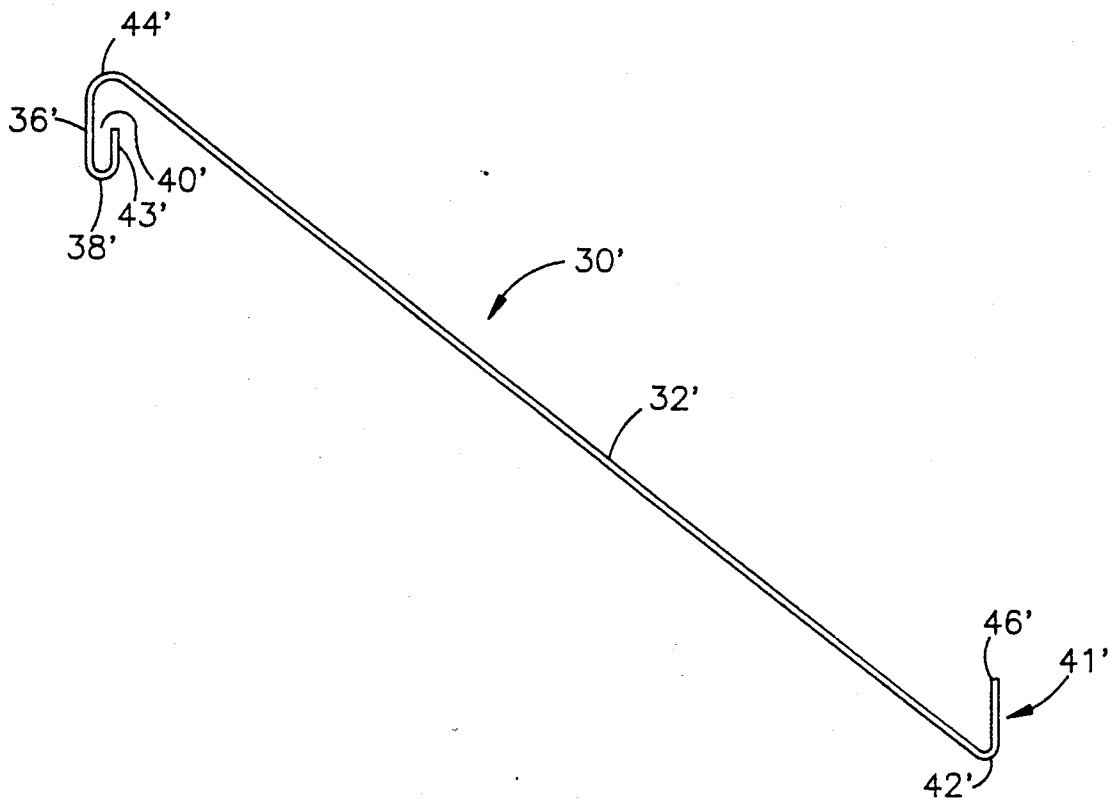
FIG. 3 is a sectional view of a blade member, of slightly different construction from that illustrated in FIG. 2, useful in practicing the invention.

The embodiment of the blade member portion of the invention illustrated in FIG. 3 is similar to that illustrated in FIG. 2 but lacks the intermediate or bridging portion 37 providing the barrier to entry of the elements into the building in which the adjustable width louver is installed; it also has a different configuration at the blade member transverse end remote from hook 38' and receptacle 40'. The blade member transverse end remote from hook 38' and receptacle 40' of the blade member embodiment 30' illustrated in FIG. 3 is denoted generally 41 and includes a first web 34', a tip portion 46' and a first intermediate portion 42' which is curved similarly to second intermediate portion 44'. However, the radius of curvature of first intermediate portion 42' is less than that of second intermediate portion 44'. The blade embodiment 30' illustrated in FIG. 3 has been numbered with corresponding numbers and prime notation to denote that the blade embodiment 30' illustrated in FIG. 3 is an alternate to the preferred embodiment 30' illustrated in FIG. 2. Similar double prime and triple prime notations are used for the embodiments of the blade members illustrated in FIGS. 4 and 5.

Figure 4:
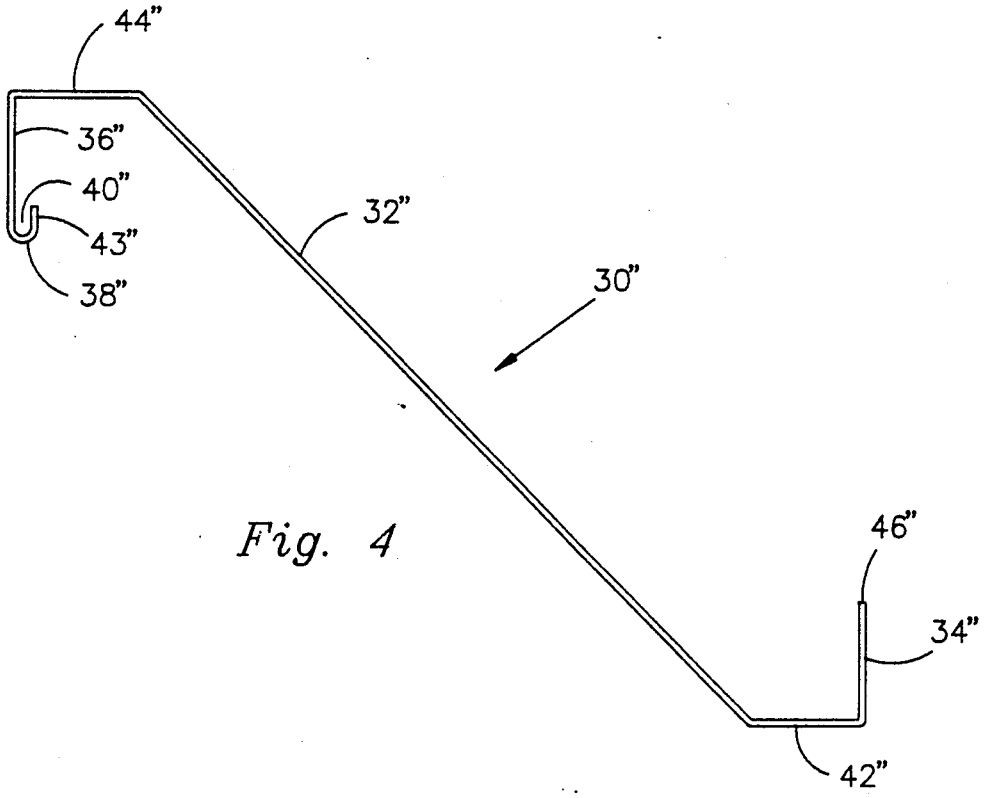
FIG. 4 is a sectional view of a blade member, of slightly different construction from that illustrated in FIGS. 2 and 3, useful in practicing the invention.
Figure 5:
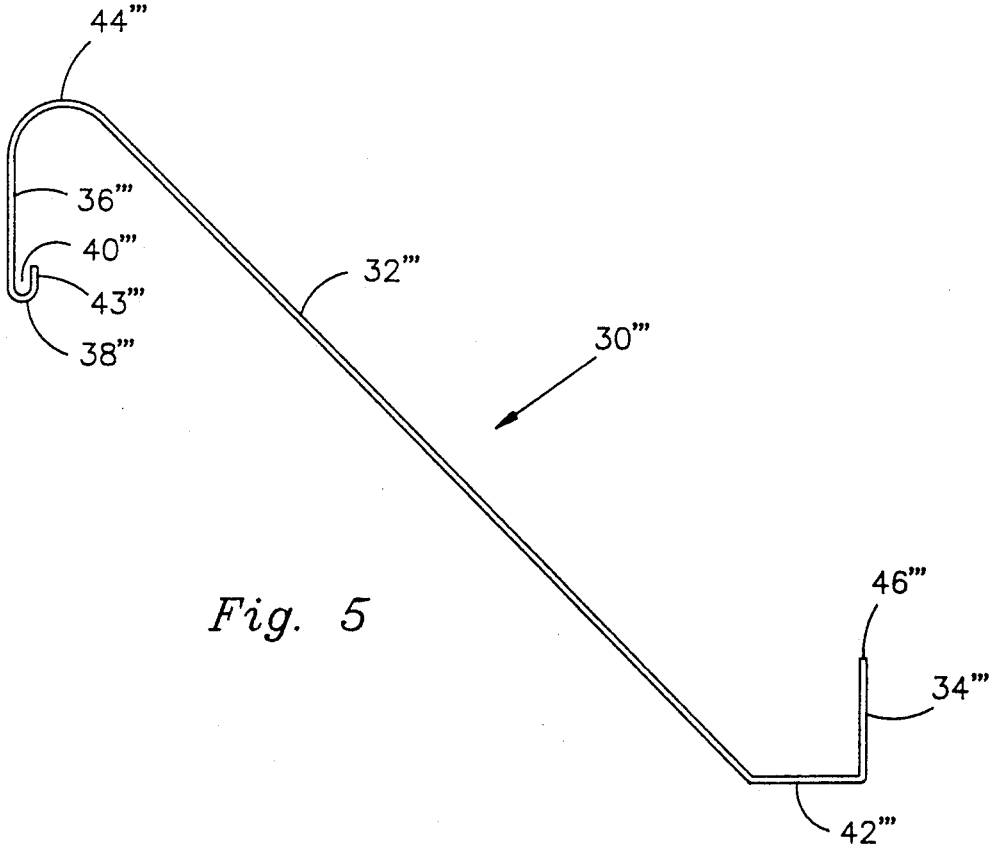
FIG. 5 is a sectional view of a blade member, of yet slightly different construction from that illustrated in FIGS. 2, 3 and 4, useful in practicing the invention.

The additional alternate embodiments of the blade member illustrated in FIGS. 4 and 5 are similar in many respects to that illustrated in FIG. 2 but lack the offset which provides th barrier to entry of the elements.

In the alternate embodiments of the blade member portion of the invention illustrated in FIGS. 4 and 5, the second intermediate portion may be straight, as shown in FIG. 4, or may be curved, as shown in FIG. 5.

In FIG. 4 second intermediate portion 44'' is preferably parallel with first intermediate portion 42'' and is generally straight or planar in configuration.

FIG. 6 illustrates the nested configuration of two blade members 30'' where tips 46'' (unnumbered in FIG. 6) of each blade member 30'', are respectively received by receptacles 40'' (also unnumbered in FIG. 6) of the remaining blade member 30'' of the pair. The pair of blade members 30'' in the nested configuration (illustrated in FIG. 6) define a blade 22'' of the adjustable width louver manifesting the invention. While the blade members 30'' illustrated in nested configuration in FIG. 6 have the blade 22'' configuration illustrated in FIG. 4, any of the blade members of the configurations shown in FIGS. 2, 3, 4 and 5 may be nested together, one with another. That is, two blade members 30 of the preferred embodiment illustrated in FIG. 2 may be nested together, two blade members 30' of the embodiment illustrated in FIG. 3 may be nested together, etc., to define a blade.

FIG. 7 illustrates the nested configuration of two blade members 30''' where the blade members are of the embodiment illustrated in FIG. 5. Other than the difference in the blade member embodiment illustrated in the drawing, FIG. 7 is substantially similar to FIG. 6.

Respecting the embodiment illustrated in FIG. 7, angle B is the angle between second web 36''' and slat portion 32''' and is preferably 45°.

In the preferred embodiment, blade member 30 is 20 gauge galvanized steel. Receptacle 40 has inner surface radius of about 0.052 inches and extends about 0.187 inches from the center, on which the radius is formed, to tip 46. This radius and lip geometry are illustrated in FIG. 10 as radius R and depth D.

The construction of the blade member illustrated in FIG. 2 is preferred because fewer manufacturing operations are required to fabricate the blade.

The adjustable louver manifesting the invention may be manufactured in a variety of sizes. One typical size is a louver about 18 inches high and adjustable from about 18 inches to about 24 inches wide; larger sizes are quite feasible.

The method of assembly of louvers embodying the invention is apparent from the exploded view of the adjustable width louver shown in FIG. 11.

Typically, the head, sill and jamb are all manufactured of 20 gauge galvanized steel. Sheet metal screws secure the assembly together; preferably zinc plated steel, self-tapping sheet metal screws are used. The screen members which may be associated with the louver are preferably one-half inch by one inch mesh 15 gauge galvanized steel.

When the invention has been embodied in a louver that has been about 18 inches high and has been adjustable from about 18 to 24 inches wide, blade members 30 have been manufactured from starting blanks which have been about seven and fifteen-sixteenth inches (7 15/16") in the direction transverse to the direction of sliding movement of the blade members. Blade members 30 have been fabricated with angle B, shown in FIG. 2, being forty-five degrees (45°).

Horizontally extending members 12, 14 defining the head and the sill preferably have their horizontal surfaces slightly pitched at an angle of the about one degree (1°); the pitch together with barrier 72 encourages water flow away from the interior of the louver.

When a louver embodying the invention is installed, typically the louver is positioned in the orifice and is expanded to a width whereby the jambs contact the lateral sides of the orifice or opening in which the louver is to fit. Once the width is fixed in this manner, screws are run through the screen, the head and the sill, thereby fixing louver width.

Louver 10 may be defined by five pieces of different design. These are the two vertically extending jambs 20, two identical inner submembers 18 and two identical outer submembers 20, which telescope to define the horizontal heads and sills, and the identical telescoping blade members 30 defining louver blades 22.

In the preferred embodiment two screens, denoted 80, 82 in FIG. 11, are also provided. Those screens are preferably sized so that when louver 10 is in its minimum width condition, the screens overlap; when louver 10 is in its position of maximum horizontal extension, the screens do not overlap and vertically extending edges are substantially adjacent to one another. The screens are preferably held in place by sheet metal screws, as illustrated in FIG. 11, and are positioned and screwed in place after the louver has been installed. Once the louver has been installed and adjusted to the desired width, the sheet metal screws are driven into place, to hold the louver at the desired width and to secure the screens in place.

While the preferred embodiment of the invention has been described above and alternative embodiments have also been described, the scope of protection to which the invention is believed entitled is defined by the claims and by equivalents thereto which perform substantially the same function in substantially the same way to achieve substantially the same result as set forth in the claims, so long as such substantial equivalents, as defined by a claim for such substantial equivalent, do not read on the prior art.

I claim:

1. A horizontally adjustable louver, comprising:

a. horizontally spaced vertically extending side members movable horizontally within a continuum of positions;

b. vertically spaced two-piece telescoping top and bottom members extending horizontally between said side members, respective first and second pieces of said top and bottom members being interchangeable; and c. telescopingly engaging pairs of blade members extending between said side members, said blade members being interchangeable and each blade member comprising:

i. a horizontally elongated web formed along one horizontally extending edge of said blade member and defining a blade member vertical extremity;

ii. a horizontally elongated hook formed along a second horizontally extending edge of said blade member and defining a blade member second vertical extremity;

iii. respective hook portions of each blade member of a pair slidably receiving webs of the paired blade member;

iv. respective hook portions of respective blade members of a pair defining respective upper and lower vertical extremities of said paired blade members.

2. The louver of claim 1 wherein respective outer telescoping pieces and respective inner telescoping pieces of said respective top and bottom members are identical.

3. The louver of claim 2 wherein said blade members of a telescopingly engaging pair are identical.

4. The louver of claim 1 wherein said blade members of a telescopingly engaging pair are identical.

5. The louver of claim 4 wherein central portions of said blade members between said hook and web are substantially planar.

6. The louver of claim 5 wherein central portions of said blade members are skew to said webs.

7. The louver of claim 6 wherein central portions are substantially at 45 degrees to said webs.

8. The louver of claim 7 wherein said webs extend vertically.

9. The louver of claim 8 wherein said hooks are open vertically.

10. The louver of claim 7 wherein said central portions of said blade members have vertically contiguous respective first, second and third portions, said second portions being substantially perpendicular to said first portions and said third portions being skew to both said first and said second portions.

11. The louver of claim 7 wherein said blade member central portions are defined by vertically contiguous first, second and third portions with said first and third portions being parallel and with first and third portions of respective blade members of a pair being disposed for sliding complemental contact with respective third and first parties of a remaining blade of said pair as horizontal width of said louver is adjusted.

12. The louver of claim 1 wherein said blade members of a telescopingly engaging pair are identical; members between said hook and web are substantially planar and skew to said webs; wherein said blade member central portions are defined by vertically contiguous first, second and third portions with said first and third portions being parallel and with first and third portions of respective blade members of a pair being disposed for sliding complemental contact with respective third and first parties of a remaining blade of said pair as horizontal width of said louver is adjusted.

13. A horizontally adjustable louver, comprising:

a. horizontally spaced vertically extending side members movable horizontally within a continuum of positions;

b. vertically spaced telescoping top and bottom members extending horizontally between said side members; and c. telescopingly engaging pairs of blade members extending between said side members, said blade members being interchangeable and each blade member comprising:

i. a horizontally elongated web formed along one horizontally extending edge of said blade member and defining a blade member vertical extremity;

ii. a horizontally elongated hook formed along a second horizontally extending edge of said blade member and defining a blade member second vertical extremity;

iii. respective hook portions of each blade member of a pair slidably receiving webs of the paired blade member;

iv. respective hook portions of respective blade members of a pair defining respective upper and lower vertical extremities of said paired blade members.

* * * * *